US005927638A

United States Patent [19]

Stahlecker

[11] Patent Number: 5,927,638

[45] Date of Patent: Jul. 27, 1999

[54] YARN TRAVERSING DEVICE ON A TEXTILE MACHINE PRODUCING CROSS-WOUND PACKAGES

[75] Inventor: Gerd Stahlecker, Eislingen, Germany

[73] Assignee: Novibra GmbH, Suessen, Germany

[21] Appl. No.: 09/042,150

[22] Filed: Mar. 13, 1998

[30] Foreign Application Priority Data

Mar. 20, 1997 [DE] Germany ..... 197 11 551

[51] Int. Cl.[6] ..... B65H 54/28

[52] U.S. Cl. ..... 242/482.8; 242/483.5

[58] Field of Search ..... 242/483.5, 470, 242/482.8, FOR 132, FOR 195

[56] References Cited

U.S. PATENT DOCUMENTS

| | | | |
|---|---|---|---|
| 1,527,485 | 2/1925 | Malassine et al. | 242/482.8 |
| 3,760,641 | 9/1973 | Espasa | 242/482.8 X |
| 5,676,324 | 10/1997 | Miyagawa | 242/482.8 |
| 5,676,325 | 10/1997 | Otoshima | 242/482.8 |

FOREIGN PATENT DOCUMENTS

3810734A1 10/1989 Germany .

*Primary Examiner*—Michael Mansen

*Attorney, Agent, or Firm*—Evenson McKeown Edwards & Lenahan, PLLC

[57] ABSTRACT

Traversing rods for yarn traversing devices on textile machines producing cross-wound packages extend over a plurality of winding points and are subjected alternately to tension and compression. The traversing rod is driven at one end by a traversing drive, and at the other end is connected to an energy storer for aiding its return of motion, which energy storer is effective in both directions of movement. As long traversing rods are continually subjected to length changes, which impede the correct build up of the packages, the return motion points of the traversing rods relative to the position of the energy storer are continuously monitored by a measuring device. The energy storer is connected to an adjusting device coupled with the measuring device and thus automatically adjustable.

21 Claims, 3 Drawing Sheets

YARN TRAVERSING DEVICE ON A TEXTILE MACHINE PRODUCING CROSS-WOUND PACKAGES

BACKGROUND AND SUMMARY OF THE INVENTION

This application claims the priority of German Application No. 197 11 551.9, filed Mar. 20, 1997, the disclosure of which is expressly incorporated by reference herein.

The present invention relates to a yarn traversing device on a textile machine producing cross-wound packages, comprising at least one traversing rod extending in machine longitudinal direction over a plurality of winding stations and subjected alternately to tension and compression. The traversing rod is driven at one end by means of a traversing drive, and, for aiding its return of motion, at the other end is connected to an energy storer whose spatial position, with reference to the return point of the traversing rod, is fixed.

Traversing rods are alternately accelerated by the traversing gear. The highest tension and compression load occurs with each return of motion or motion reversal. In particular in the case of long machines, there are considerable delays in the return of motion at the machine end facing away from the traversing gear. The mass accelerated in one direction hinders delay-free motion reversal. This inertia must be overcome. With one motion reversal, a considerable elongation of the traversing rods occurs and with the other motion reversal a corresponding compression of the traversing rods occurs. Length changes in the traversing rods measuring several millimeters occur. In the case of a long machine it is to be feared that the traversing motion is increased in both directions at the machine end, caused on the one hand by elongation and on the other by compression, which results in the varying dimensions of the cross-wound packages. The yarn guides located on the traversing rods do not undergo their return of motion (motion reversal) exactly where they should.

Attempts have been made to alleviate this problem by connecting the traversing rod at its end facing away from the traversing gear with a buffer in the form of an energy storer. This was done in such a way that towards the end of the traversing movement in one direction by the traversing rod, a pneumatic spring is compressed, by means of which in the moment of the return motion an additional force is exerted on the traversing rod (for example German published patent application 38 10 734). Such known energy storers primarily serve to compensate the pressure load of the traversing rod and to override an external tensile load during compression. Thus the length change of the traversing rod in one direction is taken into account, even if this is not expressly stated in the publication, but not, however, the length changes in the opposite direction. The known energy storer is effective namely in only one direction.

It has been shown that such energy storers are only effective over a short time. The reason for this is that the machines do not measure the same length daily, in particular over a longer period of time. The same applies to the traversing rod. The climate plays a role here, as well as heat expansion and other factors known in the industry such as the "strain" of the machine. This "strain" applies not only to the height of a machine but also to its length; it is not taken into account in the above mentioned prior art.

It has been shown that as a result of this "strain", the known energy storer can only function as long as it is sufficiently exactly adjusted. Experience has shown that the values drift after a relatively short period of time, due to the above mentioned variations in length of the machine. It cannot be assumed that a machine measures the same length exactly to the millimeter over a long period of time. This means that the energy storer, in relation to the traversing rod, moves to one side or the other, whereby, for example, in the case of the known pneumatic energy storer, the compressions spaces change their volume, so that the repulse is no longer uniform. A pneumatic force exerted at the wrong time loses its desired effect and can in extreme cases even be damaging.

It is an object of the present invention to ensure that the effectiveness of the energy storer is maintained as far as is possible over a longer period of time while taking into account the "strain" of the machine.

This object has been achieved in accordance with the present invention in that the energy storer is effective in both directions of the traversing rod, that a measuring device is provided for the constant monitoring of the point of return of the traversing rod relative to the position of the energy storer and that the energy storer is connected to an adjusting device coupled to the measuring device.

Data concerning the return motion of the traversing rod at its end facing away from the traversing gear is thus collected, and dependent thereon, corrections for the exact position of the energy storers are relayed. The device according to the present invention thus effects that a once established state attained during assembly is maintained even while taking the "strain" of the machine into account. The "breathing" of the machine and/or the traversing rod is balanced out by automatic readjustment of the energy storer in its position relative to the traversing rod. The impulse effective on the end of the traversing rod for facilitating the return motion should remain always constant in both directions.

The present invention can be particularly easily realized when the energy storer comprises in a known way a pneumatic cylinder, into which a piston, arranged on the traversing rod, is inserted and which is adjustable relative to the longitudinal direction of the traversing rod. In this embodiment, the compression spaces of the pneumatic cylinder can be adapted to the actual point of return of the traversing rod in such a way that both compression spaces always have the same volume and thus the same maximum pressure.

In certain preferred embodiments of the present invention, the traversing rod is provided with at least one signal transmitter to which a signal receiver on the pneumatic cylinder, or on a component connected thereto, is arranged. By means of such "test eyes", the current position of the traversing rod in relation to the position of the energy storer is continuously scanned.

In certain preferred embodiments of the present invention the compression spaces of the pneumatic cylinder are each connected to a pressure measuring device. In the present case, the same pressure means the same volume and guarantees that the return point of the traversing rod always maintains the same distance in relation to the two bottoms of the pneumatic cylinder.

The adjusting device according to certain preferred embodiments of the invention comprises a step motor, which is preferably controlled by a computer. The computer can not only process the data from the measuring device and transmit it to the adjusting device, it can also take into account additional traversing movements of the traversing drive and constantly adapt the energy storer thereto.

Normally the pressure attainable by the pneumatic cylinder by means of the movement of the piston is sufficient to aid the return motion of the traversing rod. In preferred embodiments of the present invention, it is possible furthermore to connect the compression spaces of the pneumatic cylinder to compressed air pipes. Thus the pressure can be increased at a desired point in time and the impulse, which facilitates the return motion, is increased.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
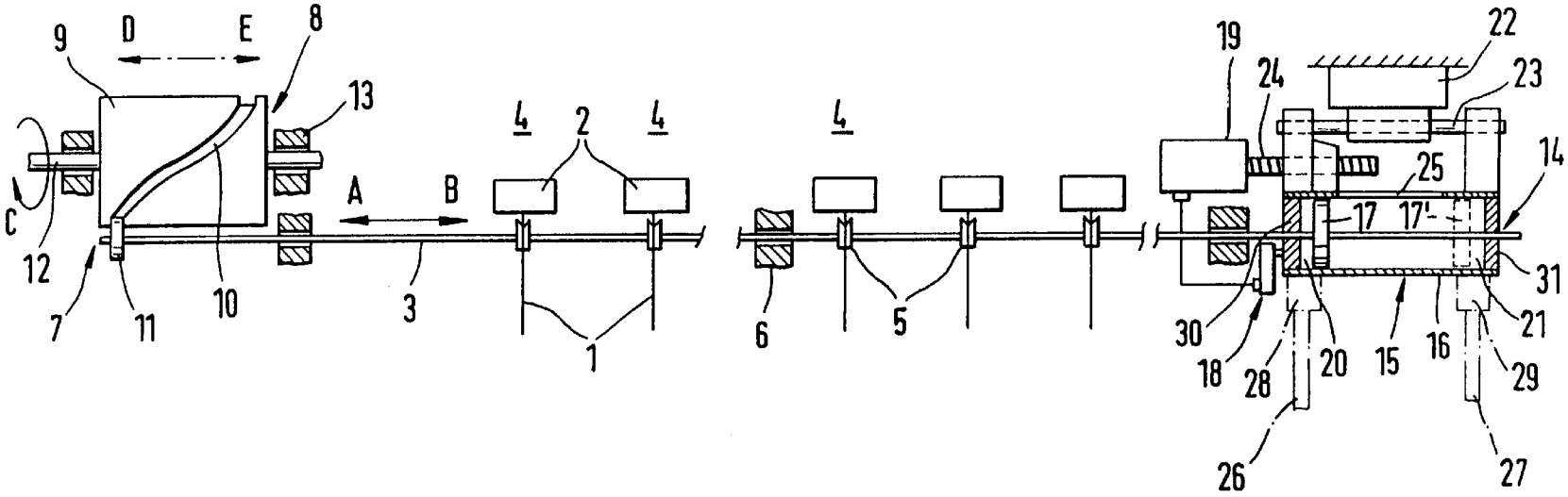
FIG. 1 is a schematic drawing of a yarn traversing device of a machine producing cross-wound packages, constructed according to preferred embodiments of the present invention.

The yarn traversing device as shown in FIG. 1 serves to traverse yarns 1 spun on a spinning machine, which yarns 1 are to be wound onto cross-wound packages 2. The traversing movement according to the directions of motion A and B is derived from a traversing rod 3 extending in machine longitudinal direction, which traversing rod 3 is provided at each winding station with a yarn guide 5. The traversing rod 3, measuring up to 30 m long, is supported at a plurality of bearing points 6 of the spinning machine.

The traversing rod 3 is driven to traversing motions at one end 7 by a traversing gear 8. The traversing gear 8 comprises a cam drum 9, which is provided in a known way with a bead or a groove 10. This drives a guiding element 11 of the traversing rod 3 to traversing movements according to the directions of motion A and B.

The cam drum 9 is arranged on a drive shaft 12, which is driven to rotate in rotational direction C in a way not shown. The drive shaft 12 is rotatably supported in bearings 13.

An energy storer 15 is arranged at the other end 14 of the traversing rod 3, which energy storer 15 comprises a pneumatic cylinder 16, in which a piston 17, connected to the traversing rod 3, traverses. The energy storer 15 serves, among other things, to facilitate the return motion of the traversing rod 3. Furthermore, in accordance with the present invention, the "strain" of the machine is taken into account.

As mentioned above, there are problems with long machines and the inevitable physical inertia of the traversing rod 3, which is subjected strongly during reversal of motion to stress, once by tensile stress and then by compression stress. In the case of a machine of approximately 30 m in length, the extension or compression of the traversing rod can measure up to 4 mm and more. This elongation and compression of the traversing rod 3 has the disadvantage, that the cross-wound packages 2, in particular in the area of the machine end facing away from the traversing gear 8, become inexact in their longitudinal dimensions. In addition it can be observed that the machine is not constantly exactly the same length over the period of one day, and in particular not over a longer period of time. This applies also to the traversing rod 3.

The present invention, described in more detail below with the aid of the following Figures provides firstly that the energy storer 15 is effective in both directions of motion A and B, that is, not only in the compression phase but also in the tension phase of the traversing rod 3, so that the length changes of the traversing rod 3 by compression and also by elongation are each taken into consideration. In addition, a measuring device 18, to be described in more detail below, is provided, which constantly monitors and corrects the relative position of the energy storer 15 in relation to the end 14 of the traversing rod 3. For this correction, an adjusting device 19 is provided, which, in dependence on the constant monitoring of the return points of the traversing rod 3 relative to the position of the energy storer 15, activates the adjusting device 19 and thus constantly readjusts the position of the energy storer 15 automatically.

In the embodiment according to FIG. 1, the traversing rod 3 extends with a piston 17 through a pneumatic cylinder 16, which comprises one or more openings 25 in its central area. The pneumatic cylinder 16 is closed at its ends by means of bottoms 30 and 31, through which the sealed traversing rod 3 is inserted. The piston 17 traverses in the interior of the pneumatic cylinder 16 up to a point in close proximity to the bottoms 30 and 31, leaving small compression spaces 20 and 21 during return motion (motion reversal). As long as the piston 17 extends through the central area of the pneumatic cylinder 16, air can escape through the openings 25. Only then in the area of the above mentioned compression spaces 20 and 21 are the openings 25 no longer effective. The exact function of the measuring device 18 is described below.

It is by all means possible to provide a plurality of energy storers 15 over the length of the traversing rod 3. Thus the length change can be prevented already in the central area of the traversing rod 3. For cost reasons, however, only one energy storer 15 is provided on the end 14 of the traversing rod 3 facing away from the traversing gear 8, according to especially preferred embodiments of the present invention.

When the traversing rod 3 traverses there is a further characteristic feature which the present invention also takes into account . If namely the yarn guides 5 were always permitted to make their return motions at the same place, then poor edges would arise on the cross-wound packages 2. There would be a risk that the edges would not be secure enough, thus resulting in the lateral falling off of larger yarn lengths. Experience has shown that the edges of the cross-wound packages 2 are better when the cam drum 9 is moved from side to side by a small amount, as is shown by the traversing directions D and E denoted by dot-dash lines. How this additional, combined traversing movement is achieved is not an object of the present invention and is thus not further described. It is, however, also possible, due to the adjusting device 19, to adapt the energy storer 15, in a way described below, to these additional traversing movements which serve to lay the edges of the cross-wound packages 2. In the case of this so-called edge laying, small distances of approximately +/−4 mm are involved. Both edges of the cross-wound packages 2 are laid at the same time in the same direction.

As shown by the compressed air pipes 26 and 27 denoted by the dot-dash lines, the compression spaces 20 and 21 can be additionally filled with compressed air, so that the impulse for facilitating the return motion of the traversing rod 2 is increased. The periodic activation of the compressed air pipes 26 and 27 can occur by means of valves 28 and 29, which are preferably controlled by a computer.

In the following Figures to be described, the same reference numbers are retained as up to now, insofar as the same, or at least functionally similar components are concerned. A repeat description of these components is thus omitted and reference is made to the description of FIG. 1.

Figure 2:
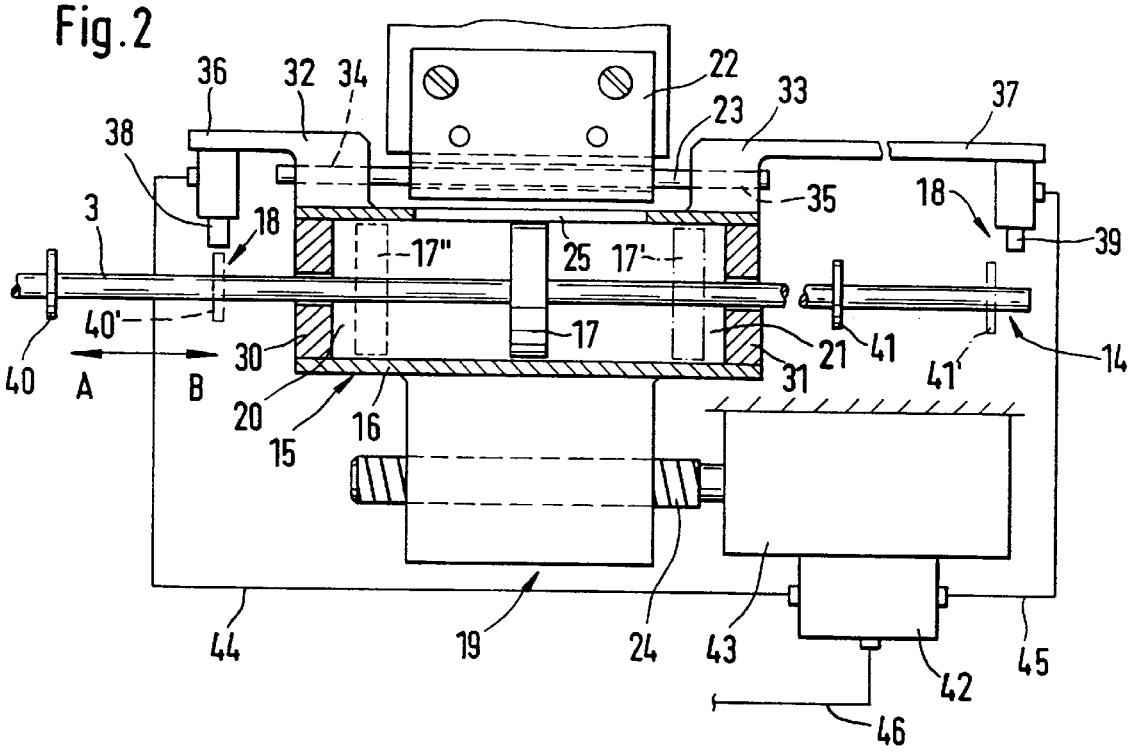
FIG. 2 is an enlarged part view of FIG. 1 in the area of the energy storer illustrating a first embodiment of a measuring device, which is connected to an adjusting device.

With the aid of FIG. 2, in comparison to FIG. 1 greatly enlarged, the function of the actual present invention is described in the following in more detail:

Firstly, attention is directed to the compression space 21, which is disposed in FIG. 2 at the right-hand sided area of the pneumatic cylinder 16, that is between the bottom 31 and the position 17' of the piston 17, shown by a dot-dash line. The position 17' shows the most possible extreme position of the piston 17 in direction of motion B. As the piston 17 in its position 17' is no longer located in the area of the central opening 25 of the pneumatic cylinder 16, the air in the compression space 21 is greatly compressed. It is presumed that the return of the traversing rod 3 takes place approximately 5 mm from the bottom 31, as in this position 17' of the piston 17 the exact amount of compression needed is generated in order to give the traversing rod 3 the necessary impulse in the new direction of motion A. The same applies when the piston 17 is located in the position 17", denoted by a broken line, and the air is compressed in the compression space 20. With regard to the compression space 20, it is presumed that the piston 17 in its position 17" also has a distance of 5 mm from the bottom 30 of the pneumatic cylinder 16. This given example position was adjusted by the fitter during assembly of the machine.

It will now be presumed that over the weekend the machine has shortened its length by 3 mm, but not the traversing rod 3. In the embodiment shown in FIG. 2, the pneumatic cylinder 16 has, in relation to the traversing rod 3, moved to the left. When the piston 17 reaches the position 17' for the return motion, it is now only 2 mm from the bottom 31. This means that the piston 17 is subjected to an increased return impulse.

When the piston 17 has reached its position 17", the bottom 30 is now 8 mm from the piston 17, that is, in the position 17" the piston 17 is subjected to a much weaker impulse.

In order to prevent the pneumatic cylinder 16, irrelevant of direction, from moving, caused by the "strain" of the machine, it is provided according to the present invention to design the pneumatic cylinder 16 movable in longitudinal direction. For this purpose, the pneumatic cylinder 16 comprises extensions 32 and 33, which are each provided with a longitudinal bore hole 34 or 35. The longitudinal bore holes 34 and 35 extend coaxially and take up a respective sliding rod 23 by means of press fit. This sliding rod 23 is inserted, with clearance, through a longitudinal bore hole of a holding device 22. The sliding rod 23 is thus movable in longitudinal direction relative to the holding device 22.

The above mentioned extensions 32 and 33 comprise arms 36 or 37, on each of which a signal receiver 38 or 39 is arranged. These signal receivers 38,39 can take the form of light barriers or the like. Modern sensors with optical eyes can, of course, also be applied.

Signal transmitters 40 and 41 in the form of thin disks are arranged on the traversing rod 3, which signal transmitters 40 and 41 are adjusted in longitudinal direction of the traversing rod 3 and which are arranged relative to the signal receivers 38 and 39 to facilitate detection of the relative position of same. The signal transmitters 40 and 41, together with the respective signal receivers 38 and 39, form the above mentioned measuring.

The signal transmitter 41 located on the right-hand side in FIG. 2 should not, in its extreme position 41', reach the signal receiver 39 during the return motion of the traversing rod 3, while the signal transmitter 40 on the left-hand side in FIG. 2 should, during the return motion of the traversing rod 3, just react to the signal transmitter 38 (Position 40'). As the position of the energy storer 15 was adjusted during assembly, the other return motion of the traversing rod 3 does not have to be taken into account by a measuring device 18. When the signal transmitter 40 has just reached the signal receiver 38 during the return motion, the distance of the piston 17 in the position 17" from the bottom 31 measures the above mentioned example of 5 mm or another sum, proved as correct by means of tests. In this case, the piston 17 would have also had the correct distance from the other bottom 30 of the pneumatic cylinder 16 in the other return position 17".

Let it be supposed that the pneumatic cylinder 16 has moved to the right due to a machine elongation. In such a case, the signal transmitter 40 would no longer reach the area of the signal receiver 38. The signal receiver 38 would relay this to the computer 42, which would activate an adjusting motor in the form of a step motor 43. The step motor 43 comprises a threaded spindle 24, which is made to rotate by the step motor 43 in the correct direction until the signal receiver 38 receives the desired signal.

If it be supposed that the machine is shorter, this means that the pneumatic cylinder 16 would move to the left in the embodiment shown in FIG. 2. The signal receiver 38 receives its signal even when the signal transmitter 40 overruns the signal receiver 38 slightly. In this case, however, the signal receiver 39, which normally would not receive a signal, also receives a signal from the signal transmitter 41. This signal from the signal receiver 39 is processed by the computer 42, which causes the step motor 43 to activate a corresponding reverse rotation of the threaded spindle 24, until the pneumatic cylinder 16 has moved sufficiently far to the right. This is the case when the computer 42 receives only the signal of the signal receiver 38.

It should be mentioned that the embodiment shown in FIG. 2 is very schematic. In practical embodiments, modern available components would be used, in particular with respect to the signal transmitters 40 and 41 and the signal receivers 38,39.

Step motors 43 are capable of making very small steps. It is possible to set the threaded spindle 24 in a rotational movement of less than 20. This means that very small adjustments of the pneumatic cylinder 16 can be made by using such a step motor 43. Strong forces can also be generated using this step motor 43.

As shown in FIG. 2, the signal receivers 38 and 39 are connected to the computer 42 by electric wires 44 and 45.

In the embodiment of the present invention shown in FIG. 2, the fundamental idea of the invention is achieved, namely to constantly adjust the pneumatic cylinder 16 automatically to the return points of the traversing rod 3. As can be further seen in FIG. 2, a further electric wire 46 is connected to the computer 42, which, in a way not shown, leads to the traversing gear 8 and relays the additional traverse movement for the edge laying on the cross-wound packages 2 to the computer 42. It is thus possible also to adjust the position of the pneumatic cylinder 16 when the cam drum 9 executes the small traversing movements for the purpose of edge laying on the cross-wound packages 2.

Figure 3:
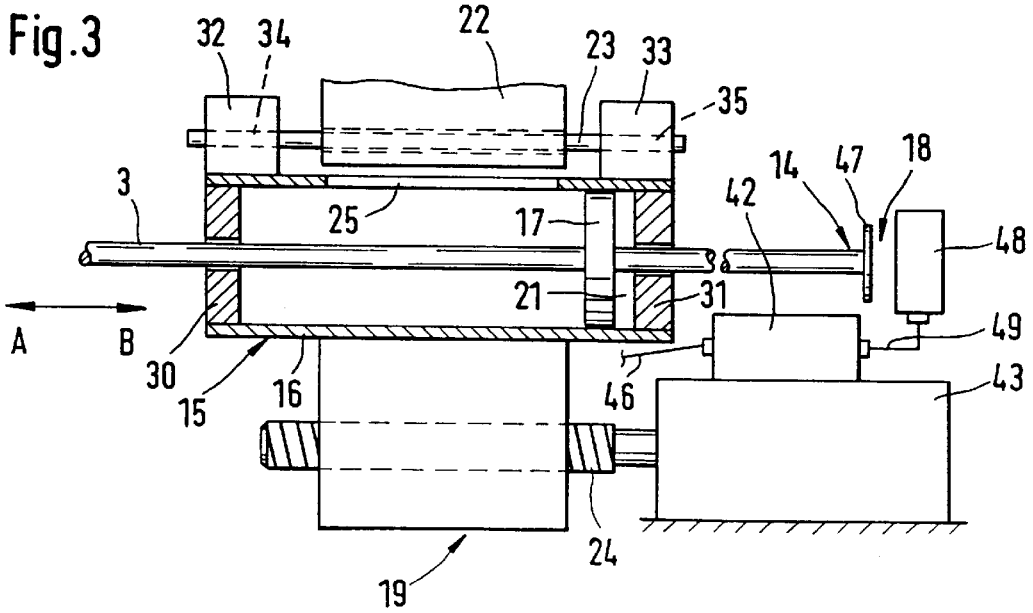
FIG. 3 is a variation of FIG. 2 with respect to the measuring device.

The embodiment of the present invention as shown in FIG. 3 differs from the device in FIG. 2 only in that the measuring device 18 has another design. In the variation according to FIG. 3 only a single signal transmitter 47 is provided, which is applied in the form of a disk at the end 14 of the traversing rod 3. When the signal transmitter 17 has reached its end position, its distance from one signal receiver 48 is established either electronically or capacitively, or by another method. As soon as the distance becomes too big or too small, the computer 42 receives an appropriate request to readjust the position of the energy storer 15 by means of the step motor 43.

Figure 4:
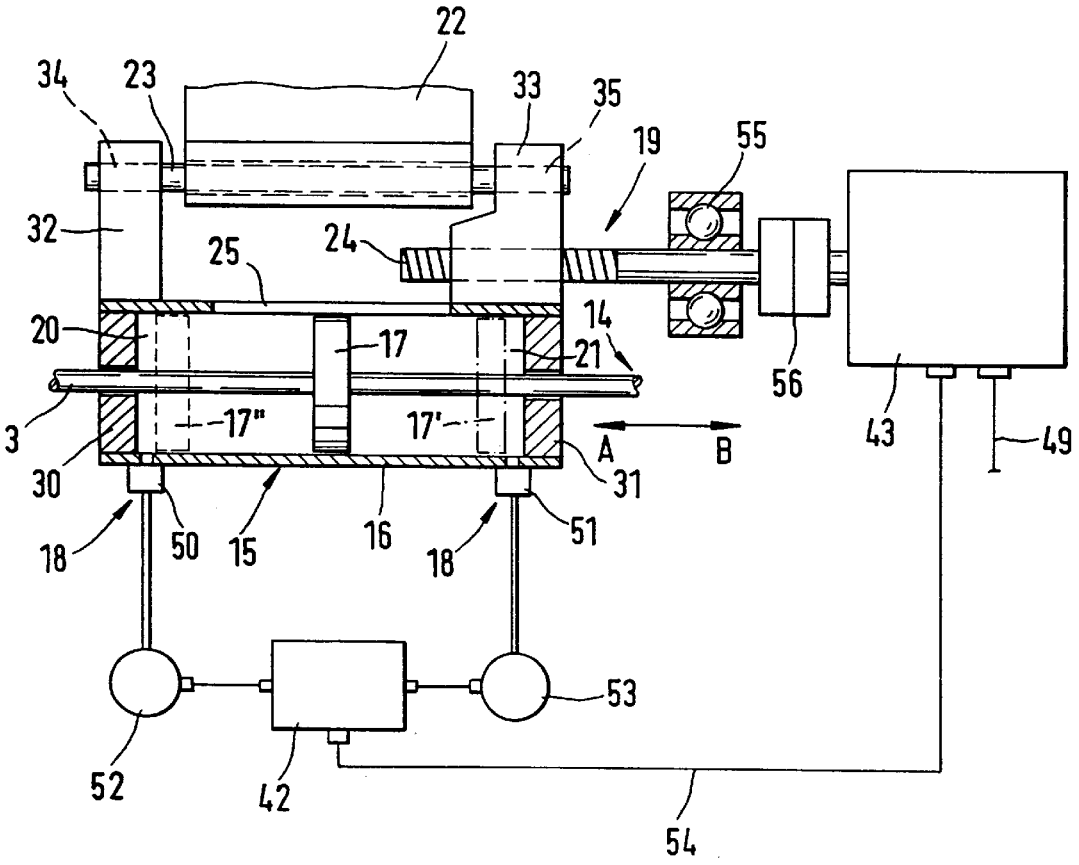
FIG. 4 is a further variation of FIG. 2 with respect to the measuring device.

In the embodiment of the present invention shown in FIG. 4, the "strain" of the machine as a result of length changes is sufficiently taken into account when the pneumatic cylinder 16 is ideally adjusted. In such a case, additional compressed air is superfluous. The original adjustment is then in order when the compression spaces 20 and 21 are both equal in relation to their volumes. The pneumatic cylinder 16 has here also one or more openings 25 in its central area, through which compressed air can escape. Only then, when the piston 17 is located in the area of the ends of the pneumatic cylinders 16, does the compression begin. Their respective maximum depends on the denoted end positions 17' and 17" of the piston 17 as shown in FIG. 4.

What is therefore important is that the distance of the piston 17 in its end positions 17' and 17" from the bottoms 31 and 30 each measures the same. It has already been explained that this is not automatically the case.

For this reason, the compression spaces 20 and 21 are connected to pressure measuring devices 50 and 51, which in this case are component parts of signal transmitters. The pressure measuring devices 50 and 51 register the maximum pressure in the pneumatic cylinder 16 at the moment of return motion of the traversing rod 3. This information is relayed to a computer 42, preferably as an electric signal. This occurs in a small component 52 or 53, which is connected to the pressure measuring devices 50 and 51.

Whenever the maximum pressure on one side of the pneumatic cylinder 16 is higher than on the other side, the step motor 43 receives an appropriate command from the computer 42, namely over an electric wire 54. The step motor 43 drives a threaded spindle 24, which passes through an extension 33 of the pneumatic cylinder 16. The threaded spindle 24 is thus capable of moving the pneumatic cylinder 16, together with its extensions 32 and 33, from side to side.

The extensions 32 and 33 are connected together by means of a pressed-in sliding rod 23. In addition, the sliding rod 23 is movable in a longitudinal bore hole of a holding device 22.

In order that the reaction pressure of the adjusting device 19 cannot damage the step motor 43, a strong bearing 55 is provided for the threaded spindle 24, for example a double-sided ball bearing. A coupling 56 of the motor shaft transmits the rotational movement to the threaded spindle 24 without being overly loaded in longitudinal direction. With this solution there is no external compressed air. Only the air present in the pneumatic cylinder 16 is used to achieve the desired repulse. This functions sufficiently well as long as the energy storer 15 is constantly readjusted automatically in the way described above.

Less complicated and costly is, of course, when the measuring devices 50 and 51 are applied and personnel are employed to measure the uniformity of the maximum pressures in both compression spaces 20 and 21 at certain intervals. In the case of the difference in the maximum pressures being too high, a manual adjustment of the energy storer 15 must be carried out.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A yarn traversing device on a textile machine which produces cross-wound packages comprising at least one traversing rod which extends in machine longitudinal direction over a plurality of winding stations, said traversing rod being subjected alternately to tension and compression, and being driven at one end by a traversing drive and connected to an energy storer at the other end for facilitating the return motion, the spatial position of said energy storer in relation to the return point of the traversing rod being predetermined, wherein the energy storer is effective in both directions of motion of the traversing rod, and wherein a measuring device for continuously monitoring the return point of the traversing rod relative to the position of the energy storer is provided and wherein the energy storer is connected to an adjusting device coupled with the measuring device.

2. A yarn traversing device according to claim 1, wherein the energy storer comprises a pneumatic cylinder, into which a piston arranged on the traversing rod is inserted and which piston is adjustable relative to the longitudinal direction of the traversing rod.

3. A yarn traversing device according to claim 2, wherein the traversing rod is provided with at least one signal transmitter, and wherein a signal receiver is arranged on the pneumatic cylinder or a component connected thereto for receiving signals from the at least one signal transmitter.

4. A yarn traversing device according to claim 3, wherein the adjusting device comprises an adjusting motor in the form of a step motor, which is controlled by a computer.

5. A yarn traversing device according to claim 3, wherein the compression spaces of the pneumatic cylinder are additionally connected to compressed air pipes.

6. A yarn traversing device according to claim 2, wherein the compression spaces of the pneumatic cylinder are each connected to a measuring device.

7. A yarn traversing device according to claim 6, wherein the adjusting device comprises an adjusting motor in the form of a step motor, which is controlled by a computer.

8. A yarn traversing device according to claim 7, wherein the compression spaces of the pneumatic cylinder are additionally connected to compressed air pipes.

9. A yarn traversing device according to claim 6, wherein the compression spaces of the pneumatic cylinder are additionally connected to compressed air pipes.

10. A yarn traversing device according to claim 2, wherein the adjusting device comprises an adjusting motor in the form of a step motor, which is controlled by a computer.

11. A yarn traversing device according to claim 2, wherein the compression spaces of the pneumatic cylinder are additionally connected to compressed air pipes.

12. A yarn traversing device according to claim 1, wherein the adjusting device comprises an adjusting motor in the form of a step motor, which is controlled by a computer.

13. A yarn traversing device according to claim 12, wherein the compression spaces of the pneumatic cylinder are additionally connected to compressed air pipes.

14. A yarn traversing device for a textile machine producing cross-wound yarn packages, comprising:

a traversing rod extending in use adjacent a plurality of yarn package winding stations;

yarn guides carried by the traversing rod and operable to guide yarn to respective yarn packages;

a traversing device operable to reciprocally drive the traversing rod;

an energy storer spaced from the traversing drive and operable to apply energy to the traversing rod to aid in direction reversal movements of the traversing rod;

a monitoring device operable to monitor the relative position of the energy storer and the traversing rod when said traversing rod movement is reversed; and an adjusting device operable to adjust the energy storer as a function of signals from the monitoring device.

15. A yarn traversing device according to claim 14, wherein the traversing drive is located at one end of the traversing rod and the energy storer is located at an opposite end of the traversing rod.

16. A yarn traversing device according to claim 14, wherein the traversing drive is a cam drive.

17. A yarn traversing device according to claim 14, wherein the energy storer comprises a pneumatic cylinder, into which a piston arranged on the traversing rod is inserted and which piston is adjustable relative to the longitudinal direction of the traversing rod.

18. A yarn traversing device according to claim 17, wherein the monitoring device includes pressure gages at respective pressure spaces of the pneumatic cylinder.

19. A yarn traversing device according to claim 18, wherein the adjusting device includes a computer controlled adjusting motor.

20. A yarn traversing device according to claim 17, wherein the monitoring device includes respective electronic signal transmitters and receivers at the traversing rod and the pneumatic cylinder.

21. A yarn traversing device according to claim 20, wherein the adjusting device includes a computer controlled adjusting motor.

* * * * *